US006026273A

United States Patent [19]

Kinouchi et al.

[11] Patent Number: 6,026,273

[45] Date of Patent: Feb. 15, 2000

[54] INDUCTION HEAT FIXING DEVICE

[75] Inventors: Satoshi Kinouchi; Osamu Takagi, both of Tokyo, Japan

[73] Assignee: Kabushiki Kaisha Toshiba, Kawasaki, Japan

[21] Appl. No.: 09/007,332

[22] Filed: Jan. 15, 1998

[30] Foreign Application Priority Data

| | | | |
|---|---|---|---|
| Jan. 28, 1997 | [JP] | Japan | 9-013640 |
| Jan. 28, 1997 | [JP] | Japan | 9-013641 |
| Jan. 28, 1997 | [JP] | Japan | 9-013642 |

[51] Int. Cl.[7] ..... G03G 15/20

[52] U.S. Cl. ..... 399/328; 219/469; 399/330; 432/60

[58] Field of Search ..... 399/328–331, 399/333–336; 432/60; 219/216, 469, 619, 671

[56] References Cited

U.S. PATENT DOCUMENTS

| | | | |
|---|---|---|---|
| 5,768,673 | 6/1998 | Morigami | 399/330 |
| 5,832,354 | 11/1998 | Kouno et al. | 399/330 |
| 5,870,660 | 2/1999 | Ito et al. | 399/330 |
| 5,881,349 | 3/1999 | Nanataki et al. | 399/328 |

FOREIGN PATENT DOCUMENTS

| | | |
|---|---|---|
| 0 642 064 | 3/1995 | European Pat. Off. . |
| 0 649 072 | 4/1995 | European Pat. Off. . |
| 0 689 107 | 12/1995 | European Pat. Off. . |
| 0 753 799 | 1/1997 | European Pat. Off. . |
| 9-197869 | 7/1997 | Japan . |

OTHER PUBLICATIONS

Patent Abstracts of Japan, vol. 096, No. 007, Jul. 31, 1996 & JP 08 069195 A (NEC Corp; INOAC Corp), Mar. 12, 1996.

*Primary Examiner*—William J. Royer
*Attorney, Agent, or Firm*—Foley & Lardner

[57] ABSTRACT

A fixing device includes a conductive and magnetic hollow roller, a metallic layer made of high thermal conductive material formed on the outer surface of the hollow roller, and a magnetic field generating coil provided in the hollow roller to generate eddy current on the hollow roller. A power source applies high-frequency current to the magnetic field generating coil and a pressure roller contacts the hollow roller in a specified nipping width. Also provided is a fixing device with a second hollow roller fitted to the outer surface of a first hollow roller, a coil provided in the first hollow roller, a current source for selectively applying current of at least two frequencies, and a third roller contacting the second roller in a specified nipping width.

18 Claims, 10 Drawing Sheets

INDUCTION HEAT FIXING DEVICE

BACKGROUND OF THE INVENTION

1. Field of the Invention

The present invention relates to a fixing device that is mounted in such image forming apparatus as, for instance, electrostatic copying machines, laser printers, etc. for heating and fixing toner images on paper.

2. Description of the Related Art

On fixing devices installed in image forming apparatus such as electrostatic copying machines, laser printers, etc., a halogen lamp, etc. are so far used as a heating source. This halogen lamp is installed in a hollow metallic roller and the metallic roller is heated from the inside when this halogen lamp is lighted. When a sheet of paper carrying an unfixed toner image is led to a nipping portion that is formed between this heated metallic roller and a pressuring roller pressed against this metallic roller at a specified pressure, the toner on the paper is melted and fixed on the paper.

However, existing fixing devices use a lamp as a heating source and thermal efficiency is limited to about 70%. In addition, as a lamp is arranged in the inside of a metallic roller to heat it from the inside, in order to heat the surface of the metallic roller that is used for the actual fixing operation it is necessary to keep the inside of the metallic roller at a temperature higher than the surface of the metallic roller. Because of this, there is such a demerit that an energy loss is large. Further, a long time is required to heat the inside of the metallic roller so that the surface of the metallic roller reaches a toner image fixable temperature. This long time becomes a factor to obstruct the reduction of a so-called rising time until an image forming apparatus reaches a usable state.

To solve these problems, there is a fixing device that was disclosed in the Japanese Publication of Unexamined Patent Application No. 07-295414. This fixing device uses a so-called induction heating method to generate eddy current on the surface of a heating roller comprising a magnetic material and directly heat the surface of the heating roller by resistance of the heating roller itself and the generated eddy current. However, in this induction heating method of the fixing device, the heating roller is composed of a magnetic material only and therefore, its thermal conductivity is low and the temperature on the surface of the heating roller becomes uneven along the axial direction of the heating roller. As a result, there are such problems that a uniform fixing performance may not be maintained, the unsatisfactory fixing may be caused and the heating roller may be filmed over by a toner.

Further, due to the low thermal conductivity, there is such a problem that the obtained fixing performance may differ depending on paper size to be fixed. That is, between a relatively large size paper using the entire longitudinal direction of the heating roller and a relatively small size paper using only a part of the longitudinal direction of the heating roller, the temperature distribution generated along the longitudinal direction of heating roller becomes uneven.

Further, there is an induction heating type fixing device disclosed in the Japanese Publication of Unexamined Patent Application No. 08-76620. This induction heating type fixing device is to heat a conductive film by a magnetic field generating means and fix a toner image on a recording medium that is closely fitted to the inductive film. That is, a nip is formed by inserting a belt between the magnetic field generating means and a heating roller and a toner image on a recording medium passing through this nip is heated and fixed thereon. In this case, however, there is such a problem that as the magnetic generating means is kept in contact with the belt that is a heating element, the heat generated on the belt moves to the magnetic generating means and heat value to be given to the recording medium decreases. Furthermore, there was also such a problem that if heat moved to the magnetic generating means, the iron loss of a coil would be caused and heating efficiency will decrease.

Further, when a paper in smaller size than the nip width was passed through the nip, a temperature difference will be produced between the passed portion and the not passed portion and there was such a problem that this temperature difference was left as a temperature hysteresis and used in the fixing of a next recording medium and an image was not uniformly fixed.

SUMMARY OF THE INVENTION

It is an object of the present invention to provide a fixing device capable of generating a uniform temperature distribution on the surface of a heating roller, providing a good energy efficiency and display a satisfactory fixing performance to paper in any size.

It is another object of the present invention to provide a fixing device capable of utilizing heat generated through the induction heating without wasting and generating no uneven temperature at the nip portion.

According to the present invention, a fixing device is provided, which comprising a conductive hollow roller; a metallic layer made of high thermal conductive material formed on the outer surface of the hollow roller; magnetic field generating means provided in the hollow roller for generating eddy current on the hollow roller; a power source for applying high-frequency current to the magnetic field generating means; and a pressure roller that is kept in contact with the hollow roller in a specified nipping width.

Further, according to the present invention, a fixing device is provided, which comprises a first hollow roller made of a first metal; a second roller fitted to the outer surface of the first roller and made of a second metal that is differing from the first metal; a coil provided in the first hollow roller and arranged by extending in the axial direction of the first and the second rollers; current applying means for selectively switching and applying a first frequency current and a second frequency current differing from the first frequency to the coil; and a third roller contacting the second roller in a specified nipping width.

Furthermore, according to the present invention, a fixing device is provided, which comprising a heating belt made of a conductive material; a pair of belt stretching rollers on which the heating belt is wound round; a pressure roller pressed against the heating belt via a specified nipping portion; magnetic field generating means arranged opposing to the back of the belt at the portion equivalent to the nipping portion of the heating belt via a specified gap for generating eddy current on the surface of the heating belt; and a power source for applying high-frequency current to the magnetic field generating means.

DETAILED DESCRIPTION OF THE PREFERRED EMBODIMENTS

Hereinafter, a first emodiment of the present invention will be described with reference to the attached drawings.

Figure 1:
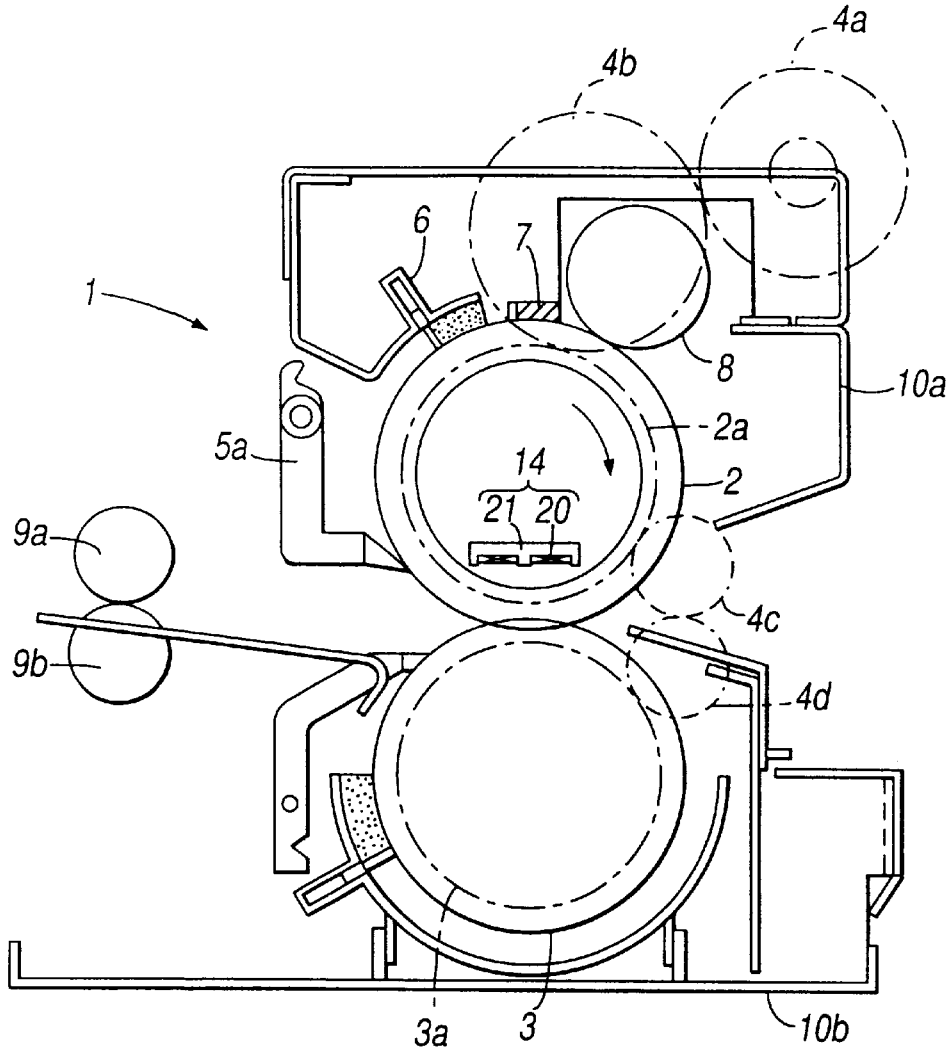
FIG. 1 is a schematic sectional view of a fixing device in a first embodiment of the present invention.

The schematic sectional view of the entire construction of a fixing device 1 is shown in FIG. 1. The fixing device 1 is composed of a heating roller 2 in diameter, for instance, of 30 mm and a pressing roller 3 in diameter, for instance, of 30 mm, which are press fitted each other while keeping a specified nipping width. When a paper carrying a toner image is passing through between the heating roller 2 and the pressing or pressuring roller 3, the toner image on the paper is heated and pressed so that the toner image is fixed on the paper. The heating roller 2 is rotated and driven by a driving motor 4*a*. That is, the driving force generated from the driving motor 4*a* is transmitted to a gear 2*a* mounted on the same shaft of the heating roller 2 via a transmission mechanism 4*b* comprising gears and the heating roller 2 is rotated and driven in the arrow direction shown in the figure. The pressuring roller 3 is rotated in the arrow direction as shown at the same peripheral speed as the heating roller 2 when the driving force is transmitted to a gear 3*a* mounted on the same shaft as the pressuring roller 3 via driving transmission mechanisms 4*c* and 4*d*.

Around the heating roller 2, a separation claw 5*a*, a cleaning unit 6, a thermistor 7 and an oil roller 8 are arranged in that order in contact with its outer surface. That is, the separation claw 5*a* is arranged at the downstream side in the rotating direction from the nipping portion of the heating roller 2 and the pressing roller 3 and separates a sheet of paper carrying a fixed image. The cleaning unit 6 removes unfixed toner, paper powder, etc. adhered on the heating roller 2. The thermistor 7 detects the temperature on the surface of the heating roller 2. The oil roller 8 applies an oil on the surface of the heating roller 2 in order to prevent toner offset on the surface of the heating roller 2.

The paper having an image fixed by the fixing device 1 is conveyed to the downstream by the rotation of the heating roller 2 and the pressing or pressure roller 3 and is ejected to the outside of the main body of the image forming apparatus by paper discharge rollers 9*a* and 9*b*. The heating roller 2 is enclosed by an upper casing 10*a* and the pressure roller 3 is enclosed by a lower casing 10*b* so as to prevent heat from escaping to the outside of the fixing device by securing the temperature atmosphere needed for the fixing.

Figure 2:
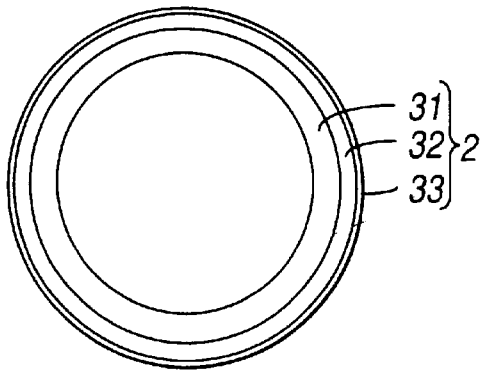
FIG. 2 is a schematic sectional view showing the construction of a heating roller of the fixing device shown in FIG. 1.

A pair of fixing rollers in this first embodiment will be described referring to FIG. 2. The heating roller 2 is composed of a hollow roller 31 made of a 1 mm thick conductive material (e.g., iron) and a metallic layer 32 made of a high thermal conductor formed on the surface of the hollow roller 31. In this embodiment, copper is used for a high thermal conductor. A separation layer 33 is provided on the outer surface of the metallic layer 32 for preventing adherence of toner, etc. In this embodiment, the 200 $\mu$m thick metallic layer 32 is formed by plating copper on the hollow roller 31. When an evaporation method or spattering method is used to form this metallic layer 32, it is possible to make the thickness of this metallic layer 32 more thin.

This heating roller 2 is kept in contact with the pressure roller 3 in a specified nipping width. The pressure roller 3 is composed of a metal core that is covered with silicon rubber, fluorine-contained rubber, etc.

Figure 3:
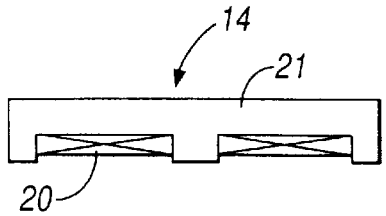
FIG. 3 is a schematic sectional view showing a magnetic field generating means in the fixing device shown in FIG. 1.

In the inside of the hollow roller 31 of the heating roller 2, a magnetic field generating means 14 is provided as a heating means. That is, the magnetic field generating means 14 is arranged at a position opposite to the nipping portion of the heating roller 2 and the pressure roller 3 in the hollow roller 31. The shape of the magnetic field generating means 14 is shown in FIG. 3. The magnetic field generating means 14 is composed by winding a copper wire composed of a litz wire round a ferrite core 21 having a high permeability plural times in one direction to form a coil portion 20. When high-frequency current is applied from a power source (not shown) to the magnetic field generating means 14, magnetic flux is generated and this generated magnetic flux is concentrated to near the nipping portion of the heating roller 2 and the pressure roller 3 by the ferrite core 21. At this time, eddy current is generated on the heating roller 2 and Joule heat is generated by this eddy current and resistance of the heating roller 2 itself. In this embodiment, the heating roller is heated by applying 10 kHz and 800 W high-frequency current to the coil portion 20 of the magnetic field generating means 14. The surface temperature of the heating roller 2 is controlled at 180° C. by intermittently applying high-frequency current referring to the detecting result of the thermistor 7 provided on the surface of the heating roller 2. In order to uniformly heat the surface of the heating roller 2, the heating roller 2 and the pressure roller 3 are rotated when the main body of the copying machine is in the ready state in this embodiment.

The heating system adopted by this system to generate eddy current by applying high-frequency current has a heat generating efficiency 80% which is higher than an existing system. In addition, as a portion required for the fixing operation only can be heated concentratedly, an extremely efficient fixing device having a fast rising time can be provided. Further, when the heating roller 2 constructed as in this embodiment is heated locally using Joule heat, an uneven heating is apt to be generated in the longitudinal direction of a coil. However, in this embodiment Joule heat is generated on the hollow roller 31 that is made of a conductive iron. The heat generated here is diffused while moving to the high heat conducive metallic layer 32 that is formed around this hollow roller 31 and therefore, the heat distribution is made uniform at the time when reaching the surface of the heating roller. Therefore, the fixing device in this embodiment has a good heating efficiency, does not generate uneven temperature on the surface and always provides a good fixing performance.

Figure 4:
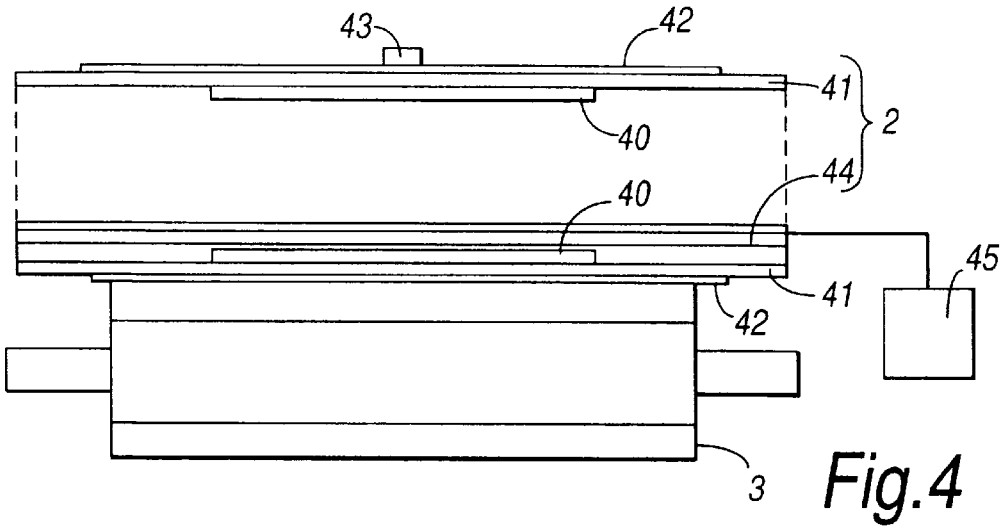
FIG. 4 is a schematic sectional view of the fixing device in a second embodiment of the present invention.

Next, a second embodiment of the present invention will be described. In this second embodiment, the construction of the heating roller in the first embodiment is deformed. The other constructions as the fixing device are the same as those of the first embodiment and the explanation thereof will be omitted. FIG. 4 shows a sectional view in the longitudinal direction of the heating roller 2 in the second embodiment. In the second embodiment, the heating roller 2 is composed of plural metallic rollers in different axial lengths. That is, the iron made hollow rollers 41 are fitted to the outsides of the copper made hollow rollers 40 so that their axial centers agree with each other. The hollow roller 40 is 210 mm long in the axial direction (equal to the latitudinal length of A4 paper size) and 1 mm thick. The hollow roller 41 has an axial length of 310 mm (slightly longer than the longitudinal length of A4 size paper or the latitudinal length of A3 size paper) and is 1 mm thick. Further, the separation layer 42 is coated on the outer surface of the hollow roller 41 to prevent toner from adhering thereto.

In the inside of the hollow portion of the heating roller 2, a magnetic field generating means 44 is arranged as a heating means. The magnetic field generating means 44 is arranged at a position opposite to the nipping portion of the heating roller 2 and the pressure roller 3. The construction of the magnetic field generating means 44 is the same as that in the first embodiment already explained referring to FIG. 2 and therefore, it is omitted here. This magnetic field generating means 44 is connected to a high-frequency current generator 45 which is a power source. This high-frequency current generator 45 is able to apply at least two kinds of high-frequency current to the magnetic field generating means 44. When high-frequency current is applied to this magnetic field generating means 44, magnetic flux is generated, and eddy current generated on the heating roller 2 and resistance of the heating roller 2 itself, the heating roller 2 is heated. Further, at a portion of the surface of the heating roller 2 corresponding to the portion where the copper made hollow roller 40 and the iron made hollow roller 41 are overlapped each other (the central portion in the longitudinal direction of the hollow rollers 40 and 41 is preferred), a thermistor 43 is provided for detecting temperatures of the surface of the heating roller 2.

The high-frequency current generator 45 generates two high-frequency currents: a first high-frequency current of 10 kHz and 800 W or a second high-frequency current of 20 kHz and 800 W. These two kinds of current are applied to the magnetic field generating means 44 selectively according to paper size.

When a paper size is A4 lateral or A3 vertical to the fixing device, it is required to heat the entire axial direction of the heating roller 2 because the fixing is made with the entire axial direction of the heating roller 2 brought in contact with a paper. In this case, the 10 kHz first current is applied to the magnetic field generating means 44 from the high-frequency current generator 45 by the action of a control means (not shown). In this case, due to difference in permeability, no eddy current is generated on copper but generated on iron. That is, when the first current is applied, the hollow roller 41 only of the heating roller 2 is heated. Thus, the entirety of A4 lateral/A3 vertical size paper is heated and a toner image can be fixed on the paper. When the heating roller 2 is locally heated (the nipping portion only) using eddy current, the temperature is apt to become uneven at the end in the longitudinal direction. In this embodiment, however, as the length of the iron made hollow roller 41 is made somewhat longer than the maximum size of fixable paper, the image fixing is not adversely affected even when the temperature at the end in the longitudinal direction of the heating roller 2 becomes uneven.

On the other hand, when the paper size is A4 vertical, the 20 kHz second current is applied to the magnetic field generating means 44 by the high-frequency current generator 45 by the action of a control means (not shown) In this case, no eddy current is generated on iron due to difference in permeability but generated on copper. That is, when the second current is applied, the copper made hollow roller 40 only of the heating roller 2 is heated. Thus, the portion of the heating roller 2 equivalent to the A4 vertical size only is heated. When the heating roller 2 is locally heated as described above, the temperature at the longitudinal end becomes uneven. However, when heating the copper made hollow roller 40, the heat generated on the surface of the hollow roller 40 is transmitted to the surface of the heating roller 2 via the iron made hollow roller 41 provided at the outside of the copper made hollow roller 40. Therefore, even when the temperature at the longitudinal end of the copper made hollow roller 40 becomes uneven, this uneven temperature is absorbed by the iron made hollow roller 41. Therefore, even when the longitudinal length of the copper made hollow roller 40 is in accord with the size of a paper to be fixed (for instance, 210 mm in case of A4 vertical paper), the improper fixing due to the uneven temperature can be prevented. That is, in order to prevent the effect of the uneven temperature generated by the local heating of a metallic hollow roller, a roller arranged at the outside must be set longer than an objective paper size (the largest size) but a roller that is arranged at the inside may be in the same length as an objective paper size.

The surface temperature of the heating roller 2 is controlled at 180° C. by turning off/on the high-frequency current intermittently referring to the detecting result of the thermistor 43 provided on the surface of the heating roller 2. In order to uniformly heat the surface of the heating roller 2, the heating roller 2 and the pressure roller 3 are rotated when the copying machine is in the ready state in this embodiment.

In the fixing device in the second embodiment in the construction as described above, it is possible to change the heating area of the surface of the heating roller 2 according to a paper size to be fixed. Therefore, waste of energy can be prevented as it is not necessary to heat the entire axial direction of the fixing roller always as before. In the above second embodiment, heating rollers are composed using rollers in lengths equivalent to two paper sizes using two kinds of materials having different permeability. However, to obtain the above effect, the construction of the heating roller is not limited to the above construction. For instance, in the above construction of the heating roller 2, the length of the copper made hollow roller 40 may be set at a length in accord with the B5 vertical size and the length of the iron hollow roller 41 may be set at a length in accord with the B5 lateral size. Further, it is also possible to further fit a roller in a material having different permeability to the heating roller 2 so that 3 kinds of high-frequency current can be generated from the high-frequency current generator 45 and the portions of the heating roller equivalent to 3 kinds of paper sizes can be selectively heated.

Further, in the above second embodiment, although the copper made short hollow roller 40 is arranged in the inside and the iron made longer hollow roller 41 at the outside, these rollers at the inside and outside may be exchanged. In this case, a dropped level portion is produced on the surface of the heating roller 2 but there will be no problem if the separation layer 42 is formed on the hollow roller 41 so that a dropped level portion is not produced.

Further, the copper hollow roller 40 may be arranged at the outside by extending its length and the iron hollow roller 41 at the inside by making its length short. In this case, if the length of the copper hollow roller is made slightly longer than the maximum size that can be fixed and the length of the iron hollow roller is kept in accord with an objective paper size, the influence of the uneven temperature generated at the end can be prevented.

Figure 5:
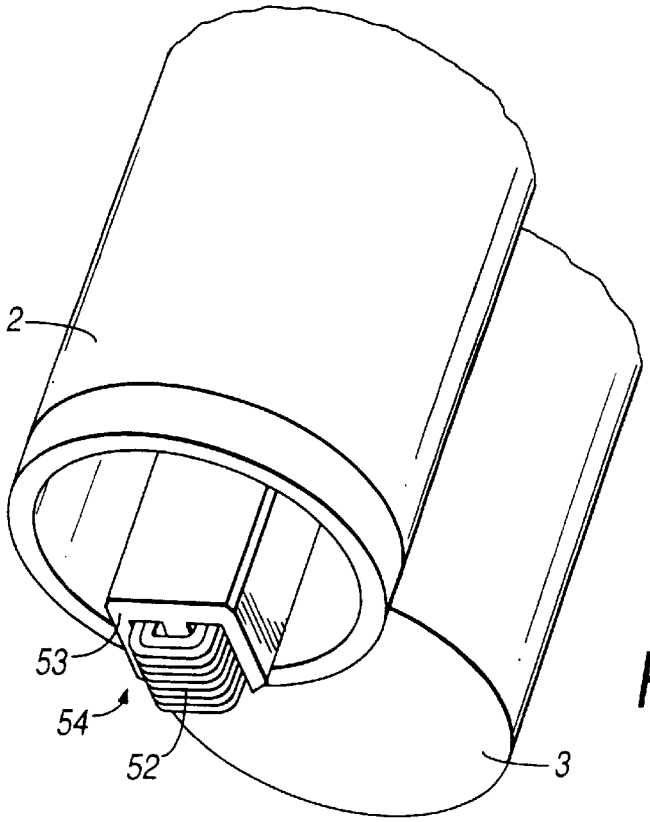
FIG. 5 is a perspective view partially showing the positional relation of the magnetic field generating means with the heating roller in a third embodiment of the present invention.

Next, a third embodiment of the present invention will be described referring to FIG. 5. In this third embodiment, the longitudinal length of a magnetic field generating means 54 provided in the heating roller 2 in the first and the second embodiments is extended longer than the longitudinal length of the heating roller 2. That is, both ends of the magnetic field generating means 54 are projected from both ends of the heating roller 2 (One end only is shown in FIG. 5). The magnetic field generating means 54 is in such structure that a copper wire in 0.5 mm diameter formed as a litz wire is wound round a coil 52 by several turns in one direction. The constructions of the heating roller 2, the pressure roller 3 and others are applicable to the same construction as described in the first and the second embodiments.

The copper wire of the magnetic field generating means 54 is turned back at its both ends and wound round a ferrite core 53 in the shape of coil. At this turned-back end, the copper wire is wound round it more closely than other portions and when the power is applied to the coil, density of magnetic flux generated at both ends of the magnetic field generating means becomes higher than other portions. As a result, the surface temperature at the portions opposite to these ends of the magnetic field generating means 54 may become higher than other portions.

According to this third embodiment, no temperature difference is produced in the axial direction on the surface of the heating roller 2 because both ends of the magnetic field generating means project from both ends of the heating roller 2. The construction that is seen in this third embodiment is also applicable to the fixing device already explained in the first and the second embodiments and the same effect can be obtained.

As explained in the first through the third embodiments, according to the fixing device of the present invention, energy loss is less and a rising time required for reaching a temperature at which an image is fixable can be made short as thermal efficiency of a heat source is satisfactory and only those portions that are used for fixing are heated.

Further, as it is possible to select the heating need at a portion that is needed for the fixing and a portion that is not needed, it is possible to reduce loss of energy in the fixing of especially small sized paper and prevent the generation of uneven temperature in the axial direction of the fixing rollers.

Figure 6:
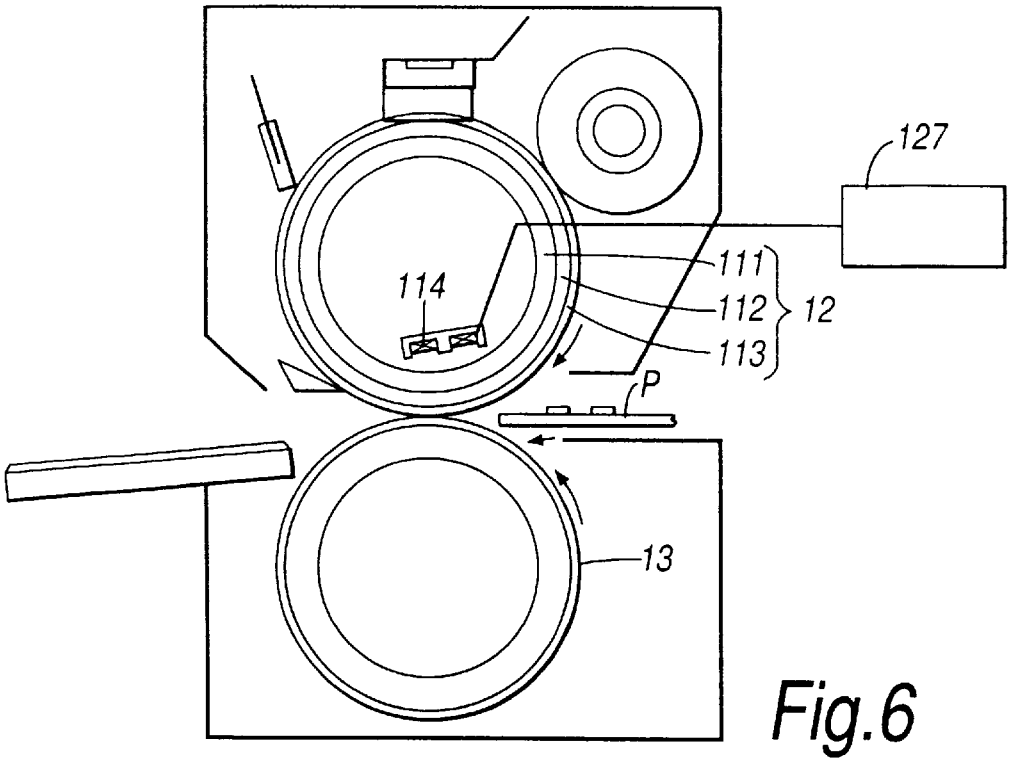
FIG. 6 is a schematic sectional view of the fixing device in a fourth embodiment of the present invention.

Next, a fourth embodiment of the present invention will be described referring to FIG. 6.

A heating roller 12 is constructed by laminating a heat insulating layer 112 and a conductive layer 113 on a hollow cylindrical base material 111. A magnetic field generating means 114 is provided in the hollow base material 111, opposing to near the nipping portion with pressure roller 13. The magnetic field generating means 114 has the same construction as the first embodiment and the explanation thereof will be omitted.

The base material 111 is composed of a glass. A 100 $\mu$m thick polyimide layer is formed on the glass base material 111 as the heat insulating layer 112 and further, a 40 $\mu$m thick nickel layer is formed at its outside as the conductive layer 113.

When high-frequency current is applied to the coil of the magnetic field generating means 114, the generated magnetic flux is concentrated to near the fixing nip portion by the ferrite core to generate eddy current on the conducive layer 113 on the heating roller 12 and Joule heat is generated. As a result, the temperature of the surface of the heating roller 12 rises to heat a paper P carrying a toner image and the toner image is fixed on the paper P. The surface temperature of the heating roller 12 is controlled to 180° C. by applying the high-frequency current from a high-frequency oscillator 117 intermittently referring to the detecting result of the thermistor provided on the surface of this heating roller 12.

When this device is used as a fixing device, it is sufficient if at least the nipping portion of the heating roller 12 and the pressure roller 13 which has a silicon rubber layer on its surface can be heated. In other words, if the width of the nipping portion becomes in accord with the width of the magnetic field generating means 114 which is a heating means, it is possible to make the heating most efficiently. However, the actual nipping portion is only about 6 mm width and the width of the magnetic field generating means 114 becomes larger than the nipping portion. Therefore, in order to use the generated Joule heat efficiently, the magnetic field generating means 114 is arranged so as to heat the nipping portion and its upstream side and not to heat the downstream side of the nipping portion in this embodiment.

The heating system adopted in this system to generate eddy current by applying high-frequency current has heat generating efficiency of more than 80%, that is higher than a conventional system. In addition, as only the portion required for the fixing operation can be heated concentratedly, a rising time is fast and it is possible to provide an extremely efficient fixing device.

The surface of the heating roller 12 can be coated with Teflon, etc. or provided with a coating mechanism of silicon oil, etc. Further, it is also possible to provide a cleaning device comprising a blade, felt, etc. or apply other known techniques. Thus, it becomes possible to avoid the surface of the heating roller 12 from becoming contaminated by offset of toner. The same effect is obtained on the surface of the pressure roller 13 if it is so constructed as the heating roller 12.

Figure 7:
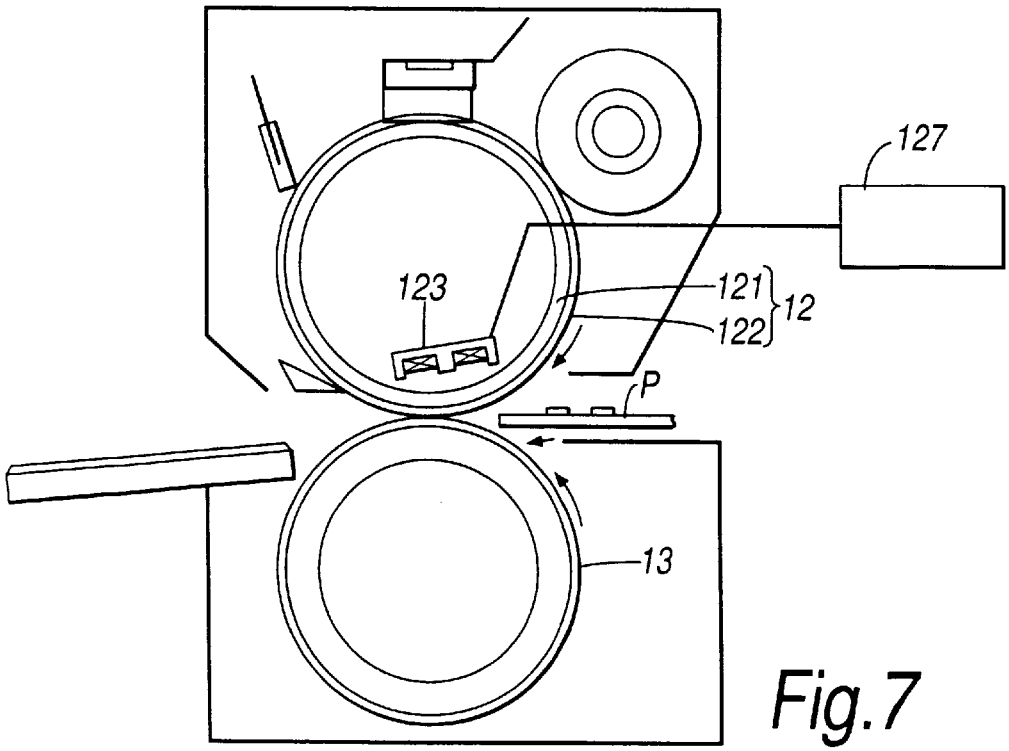
FIG. 7 is a schematic sectional view of the fixing device in a fifth embodiment of the present invention.

Next, a fifth embodiment of the present invention will be described referring to FIG. 7. An example shown in FIG. 7 is another embodiment of the heating roller 12 in the fourth embodiment shown in the above. In this fifth embodiment 5, the heating roller 12 is covered by a 40 $\mu$m thick nickel layer 122 as a conductive layer on a polyimide base material 121. In this fifth embodiment, the heat insulating layer can be eliminated and the construction can be simplified more than the fourth embodiment. Furthermore, as the hollow portion of the heating roller 12 becomes broad, a magnetic field generating means 123 that is arranged in the heating roller 12 can be made larger than the magnetic field generating means 114 in the fourth embodiment. As a result, the heating capacity can be increased although the heating insulating effect is not available and therefore, the fixing capacity comparable with the fourth embodiment is obtained. The magnetic field generating means 123 is in the same construction as that in the fourth embodiment and so, the explanation thereof will be omitted here. The magnetic field generating means 123 is connected to a high-frequency generating means 127, which is a power source.

Figure 8:
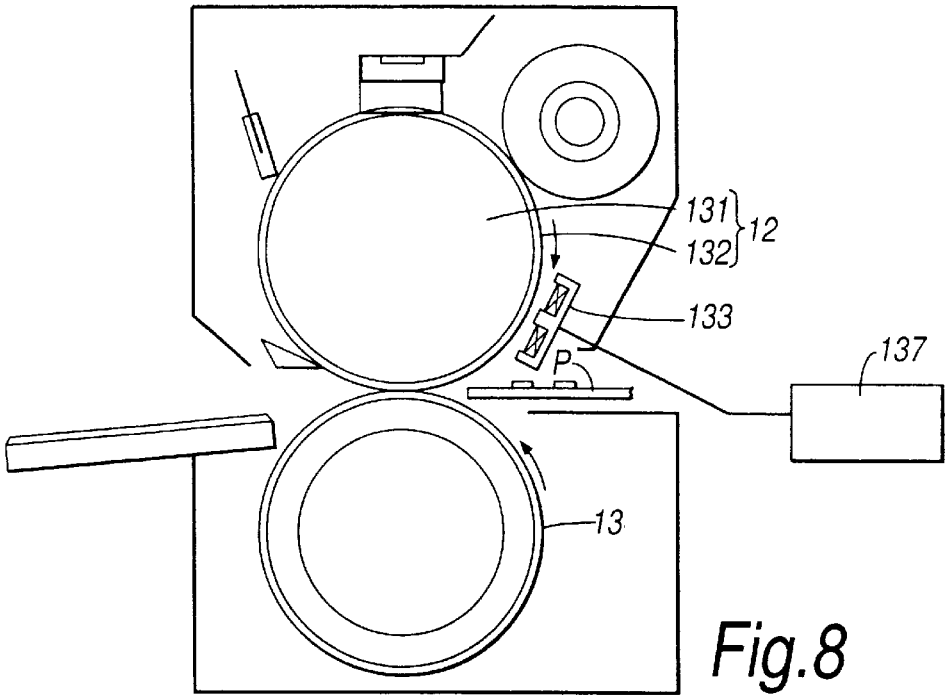
FIG. 8 is a schematic sectional view of the fixing device in a sixth embodiment of the present invention.

Next, a sixth embodiment of the present invention will be described using FIG. 8. An example shown in FIG. 8 is another example of the heating roller 12 in the fourth embodiment described above. In this sixth embodiment, the heating roller 12 has a 40 $\mu$m thick nickel layer 132 covering the surface of a solid roller 131 comprising such a conductive material as iron, etc, as the conductive layer. Because the inside of the heating roller 12 is solid, a magnetic field generating means 133 is arranged at the outside of the heating roller 12, opposing to the surface of the heating roller 12. In this sixth embodiment, the magnetic field generating means 133 is arranged to oppose to the outer surface of the heating roller 12 at the upstream side of the nipping portion. The magnetic field generating means 133 is in the same construction as that in the fourth embodiment and so, the explanation thereof will be omitted here. The magnetic field generating means 133 is connected to a high-frequency generating means 137, which is a power source.

Generally, when the thickness of the heating roller 12 is increased, its thermal capacity becomes large and a time required for heating increases. However, in case of a system to generate heat by the Joule heat as in the present invention, eddy current is generated only on the surface of the solid roller 131 for its skin effect and the heating is made from the surface, and no adverse effect is given to the rising.

Further, in the sixth embodiment, the solid roller comprising a conductor with the nickel layer formed on its surface is explained and when a solid roller comprising a conductive material is used, it is possible to heat its surface by the induction heating without necessity for forming a nickel layer on its surface.

In case of the fourth and fifth embodiments, the heating roller 12 is formed by covering the surface of the hollow glass or polyimide cylindrical body with a heat insulating layer and a conductive layer, etc. Accordingly, when, for instance, the surface of the heating roller 12 is cleaned, it can be broken if it is pressed by an excessively large force. However, when a solid roller is applied as in the sixth embodiment, the roller will not be broken and its reliability as a device can be promoted. However, as the nipping portion cannot be heated directly in the construction of the sixth embodiment, its heating efficiency is somewhat inferior to that in the fourth and the fifth embodiments.

Figure 9:
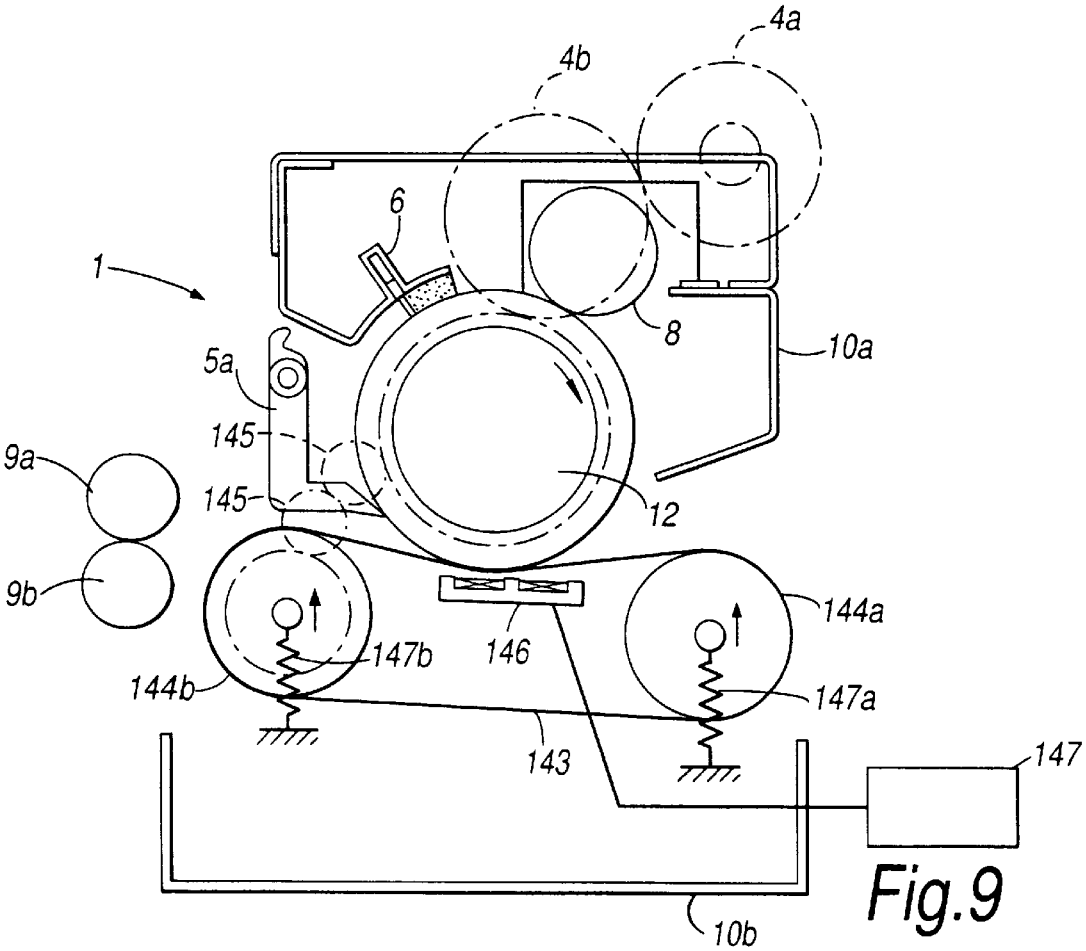
FIG. 9 is a schematic sectional view of the fixing device in a seventh embodiment of the present invention.

Next, a seventh embodiment of the present invention will be described referring to FIG. 9. In the fourth through sixth embodiments so far described, the fixing device comprising a roller pair of a heating roller and a pressure roller. In this seventh embodiment, a fixing device using a pressure belt 143 which is wound round a driving roller pair 144*a* and 144*b* instead of a pressure roller will be explained. In FIG. 9, the same component elements as those of the fixing device shown in FIG. 1 are assigned with the same reference numerals and the explanations thereof will be omitted.

In the seventh embodiment, the pressure belt 143 is pressed against the heating roller 12 at a specified pressure as the shafts of the roller pair 144*a* and 144*b* are forced upward by compression springs 147*a* and 147*b*. Therefore, when the roller 144*b* is rotated by the driving force transmitted via a driving transmission mechanism 145, the pressure belt 143 is rotated at the same speed at the nipping portion against the heating roller 12. The heating roller 12 in this seventh embodiment can be any heating roller in the construction as already explained in the fourth through the sixth embodiments. That is, the heating roller is with the polyimide layer and the nickel layer formed on the cylindrical glass body as shown in the fourth embodiment. The heating roller is with the nickel layer formed on the heat insulating material such as the cylindrical glass body or the polyimide, etc. as shown in the fifth embodiment. The heating roller is with the nickel layer formed on the iron made solid roller.

In this seven th embodiment, the fixing device is composed of the heating roller 12 and the pressure belt 143 that is made of heat resisting material (polyimide, etc.), securing a specified nipping width with this heating roller 12. A magnetic field generating means 146 is arranged at a position near the nipping portion of the pressure belt 143 and the heating roller 12 and inside of the pressure belt 143. The magnetic field generating means 146 is in the same construction as that in the fourth through the sixth embodiments and so, the explanation thereof will be omitted here. The magnetic field generating means 146 is connected to a high-frequency generating means 147 which is a power source.

In this construction, when high-frequency current is applied to the coil of the magnetic field generating means 146 from the high-frequency generating means 147, eddy current is generated on the surface of the heating roller 12 by the action of the high-frequency current flowing through the coil. The Joule heat is generated by this eddy current and the surface temperature of the heating roller 12 rises. As described above, the coil of the magnetic field generating means 146 is arranged directly under the nipping portion of the heating roller 12 and the pressure belt 143. Therefore, the nipping portion of the heating roller 12 and the pressure belt 143, that is, only the portion through which a paper passes is heated by the generated Joule heat. The surface temperature of the heating roller 12 is detected by a thermistor (not shown) and controlled at 180° C. by applying high-frequency current from the high-frequency generating means 147 intermittently while referring to this detecting result.

The heating system adopted in this seven embodiment to generate eddy current by applying high-frequency current has heating efficiency as high as more than 80% when compared with an existing system. Further, the surface acting in the image fixing is heated directly from the outside of the heating roller not from its inside and a portion required for the fixing operation is heated concentratedly. Therefore, it is possible to provide a fixing device which has a fast rising time and is extremely efficient. In particular, when compared with the fixing device explained in the fourth through the sixth embodiments, the nipping width that is used in the fixing can be made more broad as a resin made belt is used as a pressure belt. Furthermore, the amount of heat that is taken by the pressure belt when contacting the heating roller can be suppressed and thermal efficiency is extremely good.

Further, in order to prevent the surface of this heating roller 12 from being contaminated by offset of toner, etc., the surface may be coated by Teflon, etc., provided with a coating mechanism of silicone oil, etc. or a cleaning unit comprising a blade or felt, etc. Also, the surface of the pressure belt 143 can be processed in the same manner.

Figure 10:
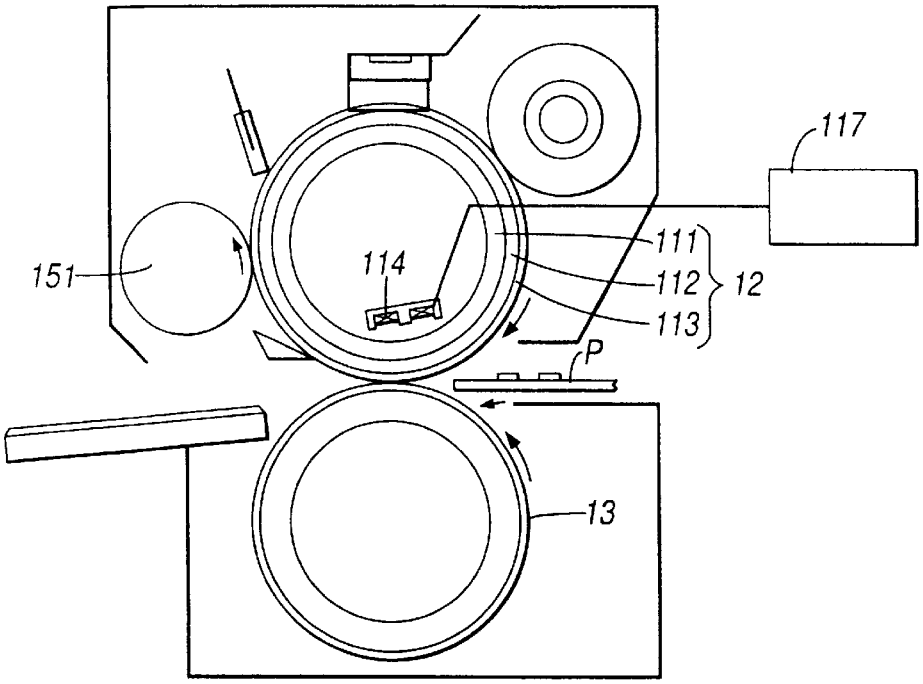
FIG. 10 is a schematic sectional view of the fixing device in a eighth embodiment of the present invention.

Next, an eighth embodiment of the present invention will be described using FIG. 10. In this eighth embodiment, the fixing device explained in the fourth embodiment with a surface temperature unifying means for unifying uneven temperature on the surface of the heating roller 12 provided are used. On the fixing device in the fourth embodiment, the nickel conductive layer 113, which is an actual heating portion, is extremely thin as low as 40 $\mu$m. So, the thermal condition on the surface is low and the surface temperature becomes uneven between the portions contacted with and not contacted with a paper after the fixing operation. Therefore, when the fixing operation is continuously performed, the surface temperature of the portion contacted with a paper in the preceding fixing was lower than that of the portion not contacted with the paper and the fixing may become defective on this portion. So, in this eighth embodiment, a roller 151 that is formed by a material of high thermal conductivity (e.g., aluminum) is compressed against the surface of the heating roller 12 at the downstream side of the nipping portion so as to increase apparent thermal conductivity of this portion. Thus, the uneven surface temperature of the heating roller 12 is made uniform.

According to the fixing device in the eighth embodiment, it is possible to always provide a uniform fixing capacity without generating uneven surface temperature by negating the temperature hysteresis on the heating roller in addition to the effect obtained in the fourth embodiment.

As described above, according to the fixing device in the fourth through the eighth embodiments, thermal efficiency of the heating source is satisfactory, with less energy loss resulting from the heating of only a portion that is used in the fixing and a required rising time to reach the fixable temperature can be made short.

Next, a ninth embodiment of the present invention will be described.

Figure 11:
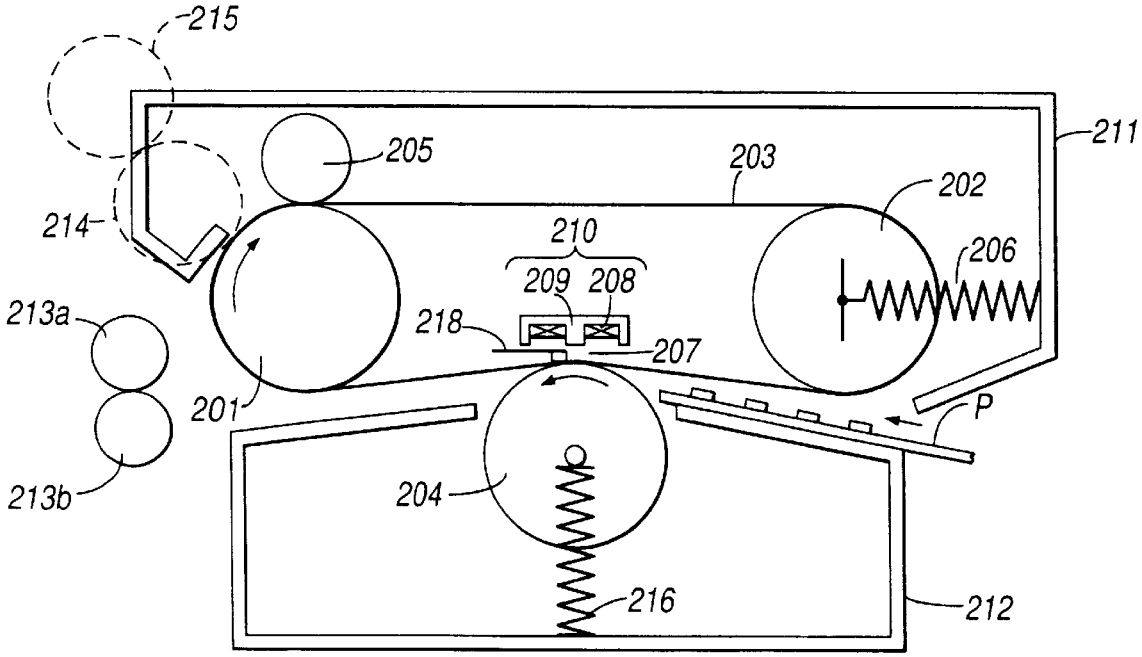
FIG. 11 is a schematic sectional view of the fixing device in a ninth embodiment of the present invention.

FIG. 11 shows a sectional view of the entire construction of the fixing device in the ninth embodiment. This fixing device is composed of a fixing belt 203 that is wound round a pair of rollers 201 and 202 and a pressure roller 204 that is pressure fit to the fixing belt 203 in a specified nipping width. A toner image carried on a paper P is fixed on the paper P by heating and pressing when the paper P is passed between the fixing belt 203 and the pressure roller 204. The roller 201 is rotated and driven in the arrow direction as shown by a driving force generated by a driving motor 215 and transmitted via a transmission mechanism 214 comprising gears, etc. One end of a spring 206 is mounted to the rotary shaft of the roller 202 and the other end of this spring 206 is fixed to an upper frame 211 of the fixing device. When the shaft of the roller 202 is pulled by the spring 206 in the right direction in the figure, a specified tensile force is given to the fixing belt 203. The pressure roller 204 is pushed up in the direction of the fixing belt 203 by a spring 216 mounted to a lower frame 212 of the fixing device. As the pressure roller 204 is pushed up, a specified nipping width is formed between the pressure roller 204 and the fixing belt 203. The pressure roller 204 is moved following the movement of the fixing belt 203 and rotated in the arrow direction as shown. An oil roller 205 is arranged so as to contact the downstream side in the rotating direction from the nipping portion with the pressure roller 204 and the outer surface of the fixing belt 203. The oil roller 205 applies oil on the surface of the fixing belt 203 to prevent a toner from offsetting on the surface of the fixing belt 203. That is, the oil roller 205 supplies oil that is held in its inside to the surface of the fixing belt 203 by rotating following the fixing belt 203.

The paper P with a toner image fixed by this fixing device is conveyed to the downstream by the rotation of the fixing belt 203 and is discharged to the outside of the main body of a copying machine by exit rollers 213*a* and 213*b*. The fixing belt 203 is enclosed by the upper frame 211 described above and the pressure roller 204 is enclosed by the lower frame 212 to prevent heat from escaping to the outside of the fixing device.

Figure 12:
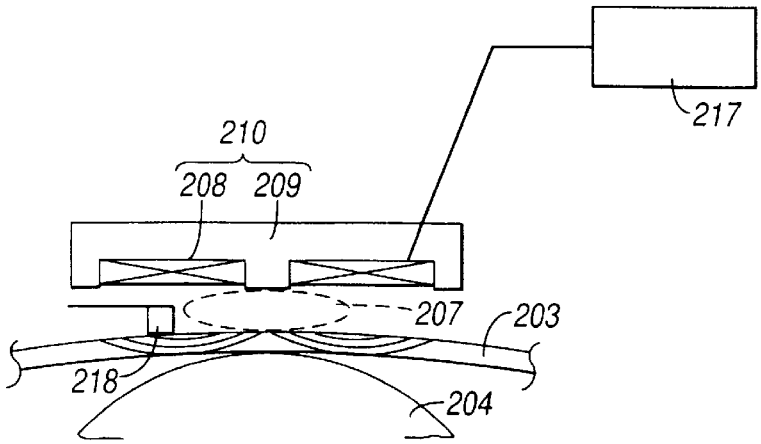
FIG. 12 is a partial sectional view for explaining the construction of a fixing portion of the fixing device shown in FIG. 11.

Next, the heating mechanism in the ninth embodiment will be described using FIG. 12. The fixing belt 203 is composed of a nickel electrocasting belt having 50 $\mu$m thickness. Here, the material of the fixing belt 203 is not limited to nickel but any strong magnetic metal conductors such as iron or stainless steel are usable. Further, on the surface of this fixing belt 203, a 20 $\mu$m thick PTFE layer or PFA layer is formed to improve separability of the fixed toner.

In the inside of the fixing belt 203, there is provided a magnetic field generating means 210 with a coil 208 composed of a copper wire in 0.5 mm diameter as a litz wire wound round a high permeability ferrite core 209 by several turns in one direction. The magnetic field generating means 210 is arranged at a position nearly opposite to the nipping portion with the pressure roller 204 in the inside of the fixing belt 203. The coil 208 of the magnetic field generating means 210 is connected with a power source 217 for applying high-frequency current. There is provided a specified space between the magnetic field generating means 210 and the fixing belt 203 and an air layer 207 is formed between the magnetic field generating means 210 and the fixing belt 203.

When high-frequency current is applied to the coil 208 of the magnetic field generating means 210 from the power source 217, magnetic flux and eddy current are generated at a portion comprising a conductive material opposite to the magnetic field generating means 210 of the fixing belt 203. The magnetic flux is concentrated especially near the nipping portion by the action of the ferrite core 209. When eddy current is generated on the surface of the fixing belt 203, Joule heat is generated by resistance of the fixing belt 203 itself and the surface temperature of the fixing belt rises.

In this ninth embodiment, the current applied to the coil 208 from the power source 217 is 20 kHz and 800 W high-frequency current. When high-frequency current is applied to the coil 208, Joule heat is generated on the fixing belt 203 according to the principle described above and the surface of the fixing belt is heated. The surface temperature of the fixing belt 203 is controlled to 200° C. by applying high-frequency current from the power source 217 intermittently referring to the detecting result of a thermistor 218 arranged near the nipping portion inside the fixing belt 203. Although, the high-frequency current applied to the coil 208 was made 20 kHz in the ninth embodiment, if high-frequency current is between 10–600 kHz, it is possible to generate Joule heat that is applicable as a heating means.

Figure 13:
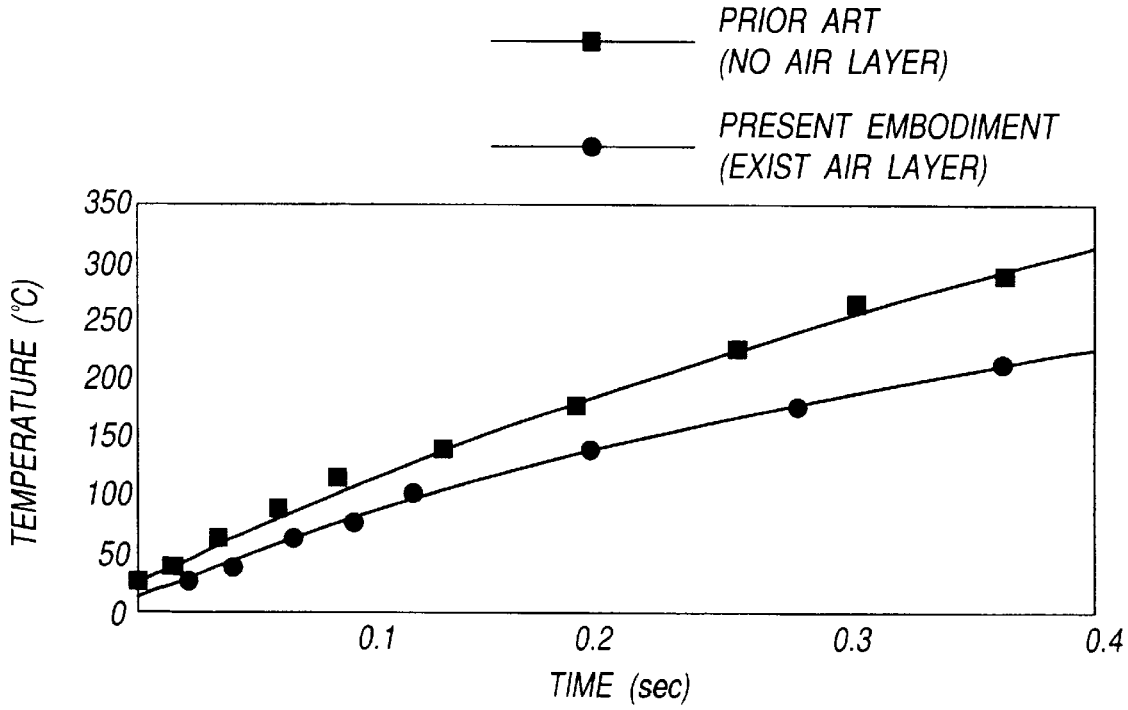
FIG. 13 is a graph showing the result of the thermal analysis when an air layer was formed between a fixing belt and the magnetic field generating means in the ninth embodiment of the present invention and that when a heat insulating material was arranged between the fixing belt and the magnetic field generating means.

Here, the magnetic field generating means 210 is opposing to the fixing belt 203 via the air layer 207 in the ninth embodiment. Because of this, there is scarcely existing contact thermal resistance accompanied with the thermal transfer to a toner on a paper P from the fixing belt 203 in the fixing operation. Therefore, thermal efficiency is extremely excellent when compared with a conventional construction for heating via such insulators as glass, etc. between a coil and a belt. The results of thermal analyses of the construction in the ninth embodiment and the conventional construction are shown in FIG. 13. Here, a distance between the magnetic field generating means 210 and the fixing belt 203 is 8 mm and the air layer was formed between them in the ninth embodiment while a plate glass was provided as an insulator between them in the conventional example. As a matter of course, it is needless to say that the more close the distance between the belt and the coil is narrowed, the more efficiency is improved. At this time, the material of the fixing belt 203 was a 50 $\mu$m thick electroformed nickel belt like the ninth embodiment and 20 kHz and 800 W high-frequency current was applied to the coil. When times required for the surface temperature of the fixing belt 203 to reach 200° C. were compared, 3.5 sec. was required for the conventional construction and according to the ninth embodiment, 0.23 sec was required to reach 200° C. and a rising time can be sharply reduced.

In order to improve fixing efficiency it is needed to concentrate eddy current to the nipping area of the fixing belt 203 and the pressure roller 204 and in the above ninth embodiment, magnetic flux density is concentrated by the action of the ferrite core 209 of the magnetic field generating means 210. However, as there is provided a certain air layer 207 for improving thermal efficiency as described above, it is required to bring the coil 208 in contact with the fixing belt 203 to further concentrate magnetic flux. Here, if a ferrite material is selected as a material of the pressure roller 204, it becomes possible to concentrate magnetic flux to the nipping portion without bringing the coil 208 close to the belt 203. It is thus possible to increase the amount of heat generated at the nipping portion by concentrating magnetic flux to the nipping portion and perform the fixing efficiently. Further, the concentration of magnetic flux produces an effect to prevent magnetic flux from leaking to the outside.

Figure 14:
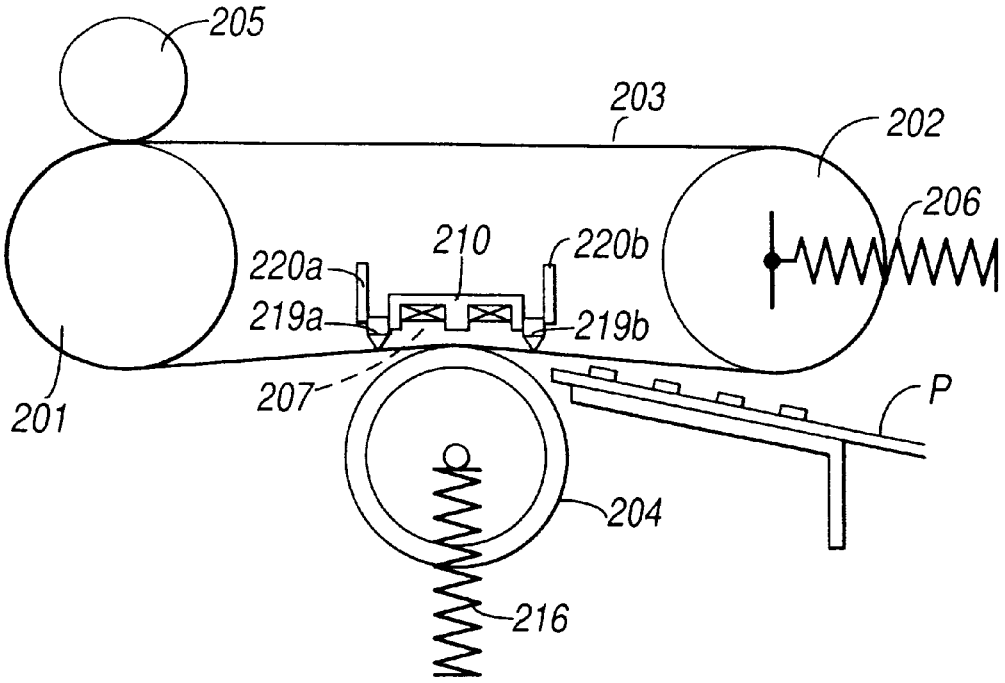
FIG. 14 is a schematic sectional view of the fixing device in a tenth embodiment of the present invention.

Next, a tenth embodiment of the present invention will be described referring to FIG. 14. In the example shown in FIG. 14, the magnetic field generating means 210 in the ninth embodiment is positioned to maintain a certain distance always to the fixing belt 203. That is, the fixing device is so constructed that the air layer 207 formed between the magnetic field generating means 210 and the fixing belt 203 is always kept at a fixed thickness to obtain a fixed heat insulating effect. In the tenth embodiment, a pair of rails 220*a* and 220*b* are provided in the fixing belt 203. Along these rails 220*a* and 220*b*, the magnetic field generating means 210 is arranged so as to be able to slide in the vertical direction. At the fixing belt 203 side of the magnetic field generating means 210, a gap adjusting members 219*a* and 219*b* are mounted so that it is fixed against the magnetic field generating means 210. When rollers provided at the ends of these gap adjusting members 219*a* and 219*b* contact the fixing belt 203, the magnetic field generating means 210 is positioned while keeping a fixed distance to the fixing belt 203. As a result, the thickness of the air layer 207 becomes constant and a fixed heat insulating effect is obtained and therefore, constant thermal efficiency can be always obtained.

Figure 15:
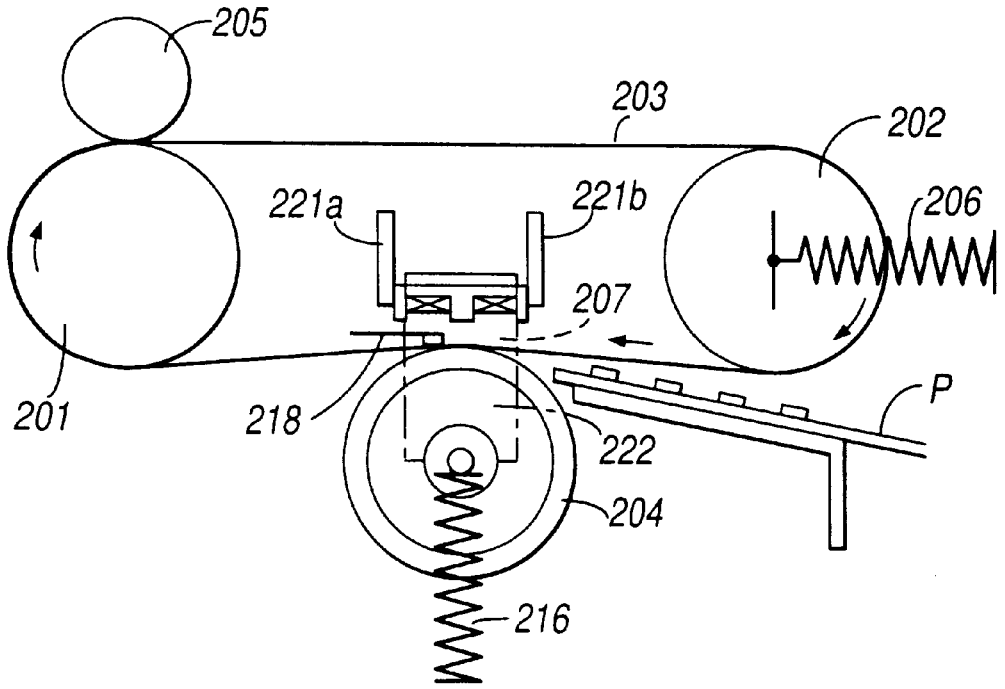
FIG. 15 is a schematic sectional view of the fixing device in an eleventh embodiment of the present invention.

Next, an eleventh embodiment of the present invention will be described referring to FIG. 15. In the example shown in FIG. 15, it is so constructed that the thickness of the air layer 207 does not change even when the amount to push up the fixing belt 203 by the pressure roller 204 was changed in order to change the nipping width of the fixing belt 203 and the pressure roller 204 in the tenth embodiment. In the eleventh embodiment, a pair of rails 221*a* and 221*b* are provided in the fixing belt 203 and along these rails 221*a* and 221*b*, the magnetic field generating means 210 moves in the vertical direction while its lateral movement is regulated. One end of a plate shape positioning member 222 is fixed at a part of the magnetic field generating means 210 and the other end of the positioning member 222 is fixed at a shaft 223 of the pressure roller 204. Thus, the magnetic field generating means 210 and the pressure roller 204 are in a fixed relation with each other and when the pressure roller 204 moves vertically, the magnetic field generating means 210 also moves vertically while keeping a fixed distance to the pressure roller 204.

When adjusting the nipping width between the pressure roller 204 and the fixing belt 203 in order to improve the fixing performance, if the amount of pushing of the fixing belt 203 by the pressure roller 204 is increased, the nipping width becomes large and if decreased, the nipping width becomes small. At this time, if it is constructed like the eleventh embodiment, when the pressure roller 204 moves, the magnetic field generating means 210 moves by the amount of the fixing belt 203 moved and the distance between the fixing belt 203 and the magnetic field generating means 210 does not change relatively. Accordingly, magnetic flux and eddy current generated on the fixing belt 203 by the magnetic field generating means 210 can be maintained always at constant values, preventing the temperature distribution from becoming uneven in the fixing operation.

Figure 16:
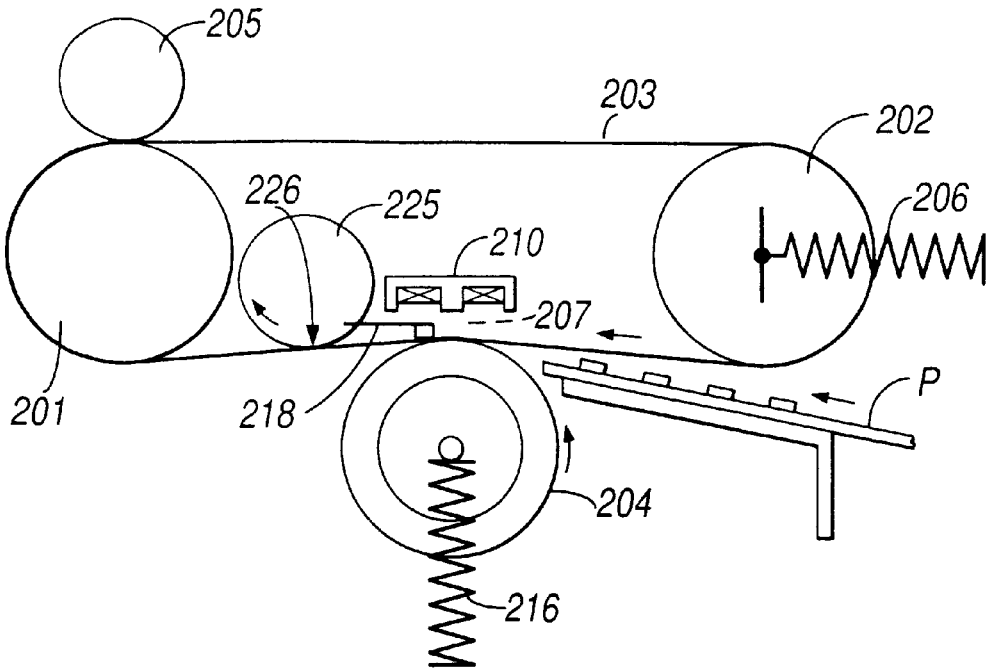
FIG. 16 is a schematic sectional view of the fixing device in twelfth embodiment of the present invention.

Next, a twelfth embodiment of the present invention will be described referring to FIG. 16. The twelfth embodiment is constructed so as to eliminate generation of uneven temperatures on the fixing belt 203 especially after the fixing operation in the fixing device in the eleventh embodiment. Here, the same component elements in this embodiment as those in the ninth embodiment will be assigned with the same reference numerals and the explanations thereof will be omitted.

In the twelfth embodiment, an aluminum made temperature hysteresis removing roller 225 having high thermal conductivity is arranged in the fixing belt 203 and at the downstream side of the nipping portion of the fixing belt 203 and the pressure roller 204. This temperature hysteresis removing roller 225 has a length almost equal to the width of the fixing belt 203 in its axial direction and is kept in contact with the back of the fixing belt 203. Accordingly, the temperature hysteresis removing roller 225 is rotated in the arrow direction as shown in company with the movement of the fixing belt 203. As a result of this construction, the nipping portion 226 between the temperature hysteresis removing roller 225 and the fixing belt 203 has an apparently higher thermal conductivity than other portions of the fixing belt 203. Therefore, when fixing is made on small size paper, etc., uneven temperatures are generated on the fixing belt 203 for a portion contacting the paper (the paper passing portion) and a portion not contacting the paper (the paper not passed portion). However, when the fixing belt 203 is brought in contact with the temperature hysteresis removing roller 225, heat moves between the high and low temperature portions in the cross direction of the fixing belt 203 and the uneven temperature generated in the cross direction of the fixing belt 203 is removed. Thus, a uniform fixing performance can be provided without generating uneven temperature on the fixing portion (the nipping portion between the fixing belt 203 and the pressure roller 204).

Further, an aluminum made roller was used for the temperature hysteresis removing roller 225 in the twelfth embodiment but the roller material is not limited to this and any high thermal conductive materials are usable. Further, the temperature hysteresis removing roller 225 is arranged in the fixing belt 203 and is kept in contact with the back surface of the fixing belt 203. It is however not limited to this but even when it is arranged so as to contact the front surface of the fixing belt 203, an uneven temperature removing effect can be obtained. In this case, however, the temperature hysteresis removing roller may be contaminated by toner, etc. and if used for a long period, its uneven temperature removing effect can be decreased. It is therefore desirable to arrange the temperature hysteresis removing roller 225 in the inside of the fixing belt 203.

Figure 17:
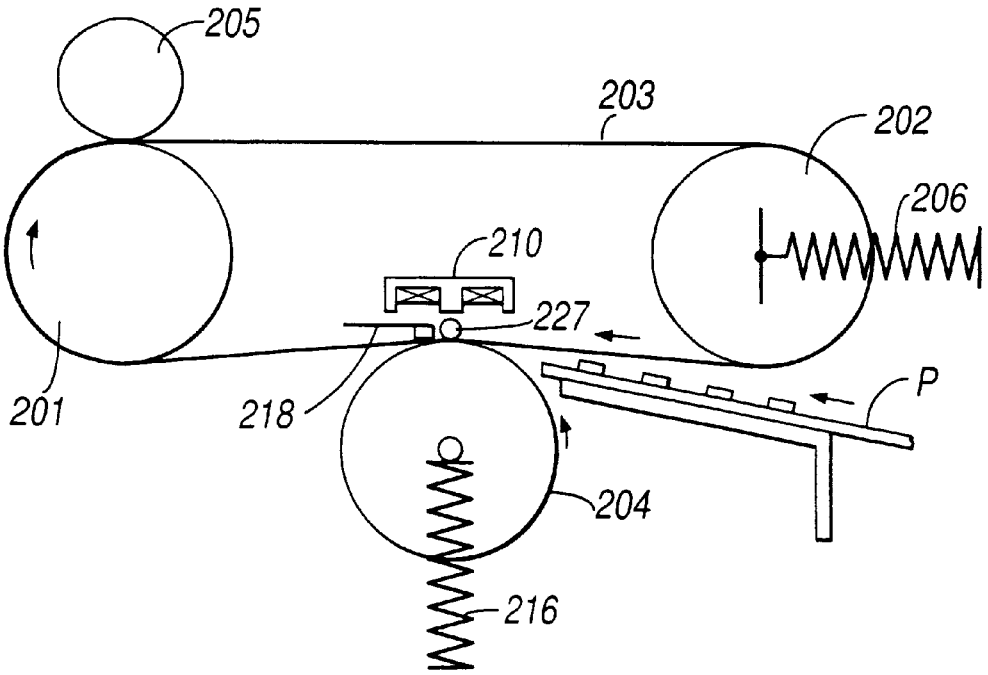
FIG. 17 is a schematic sectional view of the fixing device in a thirteenth embodiment of the present invention.

A thirteenth embodiment of the present invention will be described referring to FIG. 17. In this thirteenth embodiment, the uneven temperature generation at the fixing portion (the nipping portion between the fixing belt 203 and the pressure roller 204) is removed by a method differing from the method in the twelfth embodiment. Here, the same component elements as those in the ninth embodiment will be assigned with the same reference numerals and the explanations thereof will be omitted. In the thirteenth embodiment, a heat pipe 227 is provided between the fixing belt 203 and the magnetic field generating means 210. The heat pipe 227 is kept in contact with the inside of the fixing belt 203 that is equivalent to the nipping portion between the fixing belt 203 and the pressure roller 204. A distance between the magnetic field generating means 210 and the fixing belt 203 is 8 mm like the ninth embodiment and the diameter of the heat pipe 227 is 2 mm. The length of the heat pipe 227 is almost equal to the cross directional length of the fixing belt 203. The heat pipe 227 is made of copper and water is used as an operating fluid.

When the fixing of a small sized paper, etc. was performed, uneven temperatures were generated on the fixing belt 203 for the portion contacted by a paper (the paper passing portion) and the portion not contacted by a paper (no paper passing portion). However, the movement of heat is taken place between the high and low temperature portions in the cross direction of the fixing belt 203 by the action of the heat pipe 227 arranged on the back of the nipping portion. By this heat movement, the uneven temperature in the cross direction of the fixing belt 203 is removed. So, it becomes possible to provide an uniform fixing performance without generating the uneven temperature on the fixing portion (the nipping portion of the fixing belt 203 and the pressure roller 204).

Here, as being arranged at the nipping portion in the thirteenth embodiment, the heat pipe 227 is at a position subject to the effect of the magnetic field generating means 210. However, while the frequency for induction heating of nickel is 10 kHz, the frequency for induction heating of copper is 20 kHz and therefore, in this embodiment, high-frequency current of 10 kHz and 800 W is applied to the coil 208 of the magnetic field generating means 210 from the power source. By this current, the nickel made fixing belt 203 only is heated and the copper made heat pipe 227 itself is never be heated. Therefore, even when the heat pipe is provided near the magnetic field generating means 210, its heat exchanging action is not affected. In short, as a material for the heat pipe 227, any material requiring frequency for induction heating differing from that of the fixing belt 203 should be selected.

In the twelfth and thirteenth embodiments described above, it is aimed to remove the uneven temperatures in the cross section at the fixing portion (the nipping portion) generated on the fixing belt 203 by the amount of heat derived by a paper in the fixing operation. Here, the portions other than the portion kept in contact with a paper on the fixing belt 203 are kept in contact with the surface of the pressure roller 204 during the fixing operation. Further, the entire fixing portion of the fixing belt 203 is contacting the pressure roller 204 during the time other than the fixing operation (that is, a time between a paper first conveyed and a paper to be conveyed next). As the pressure roller 204 itself is not heated, heat will escape from the heated surface of the fixing belt 203 to the pressure roller 204. However, to improve thermal efficiency of the fixing device it is desirable to prevent the heat generated on the fixing belt 203 from escaping without use. So, in fourteenth and fifteenth embodiments shown below, a deformed example of a fixing device with less escaping of heat from the heated fixing belt 203 will be explained.

Figure 18:
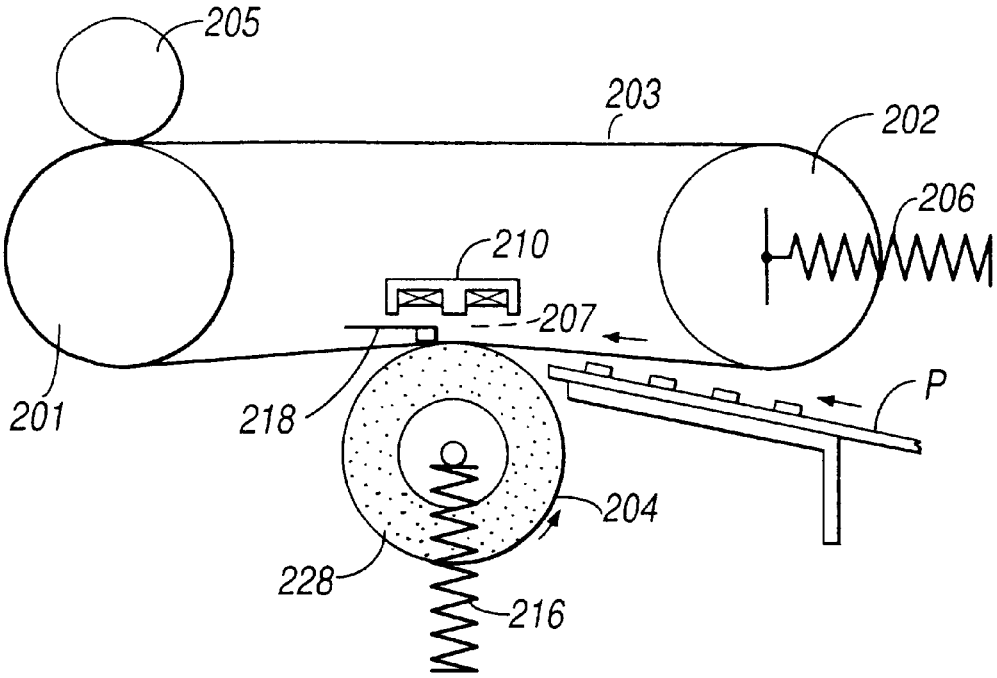
FIG. 18 is a schematic sectional view of the fixing device in a fourteenth embodiment of the present invention.

First, the fourteenth embodiment will be explained referring to FIG. 18. In this fourteenth embodiment, the construction other than that of the pressure roller is the same as that shown in the ninth embodiment, the explanation thereof will be omitted. In the fourteenth embodiment, a silicon foamed rubber roller 228 is used as the pressure roller. This foamed rubber roller 228 is pressed against the fixing belt 203 by a spring 216 as in the already explained other embodiments, forming a specified nipping width between the fixing belt 203.

The foamed rubber roller 228 has many holes on its surface or inside and retains air in each of the holes and these serve as heat insulating materials. Therefore, even when this foamed rubber roller 228 contacts the fixing belt 203, heat escaping from the fixing belt 203 is less. Thus, even when the fixing belt 203 and the foamed rubber roller 228 directly contact each other between an unfixed preceding paper and succeeding paper, heat generated on the fixing belt 203 and taken by the rubber roller 228 is less and thermal efficiency is extremely good.

Figure 19:
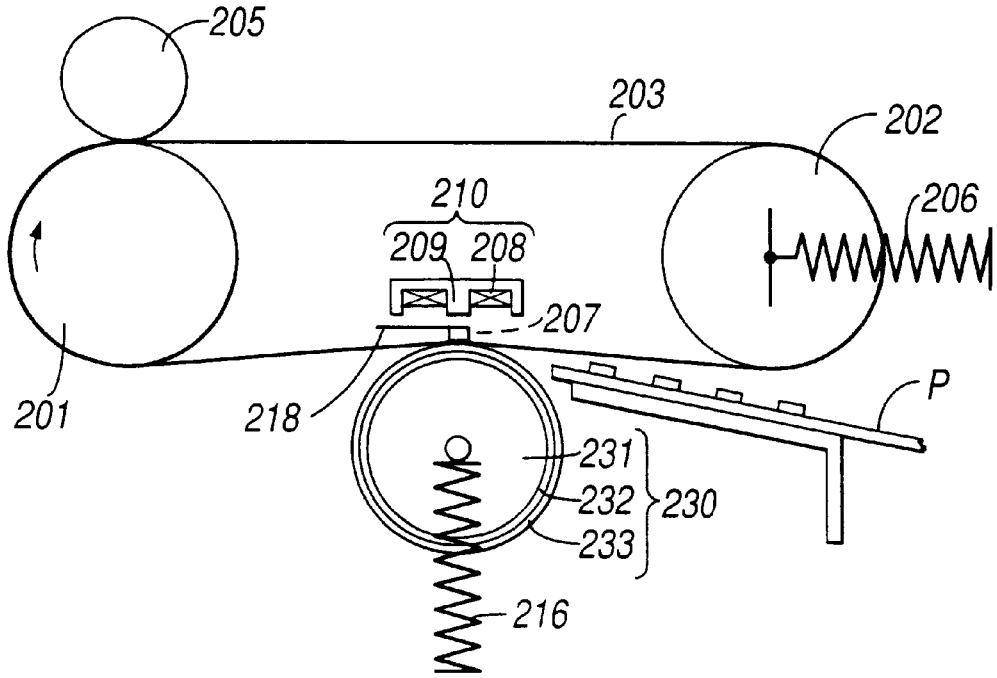
FIG. 19 is a schematic sectional view of the fixing device in a fifteenth embodiment of the present invention.
Figure 20:
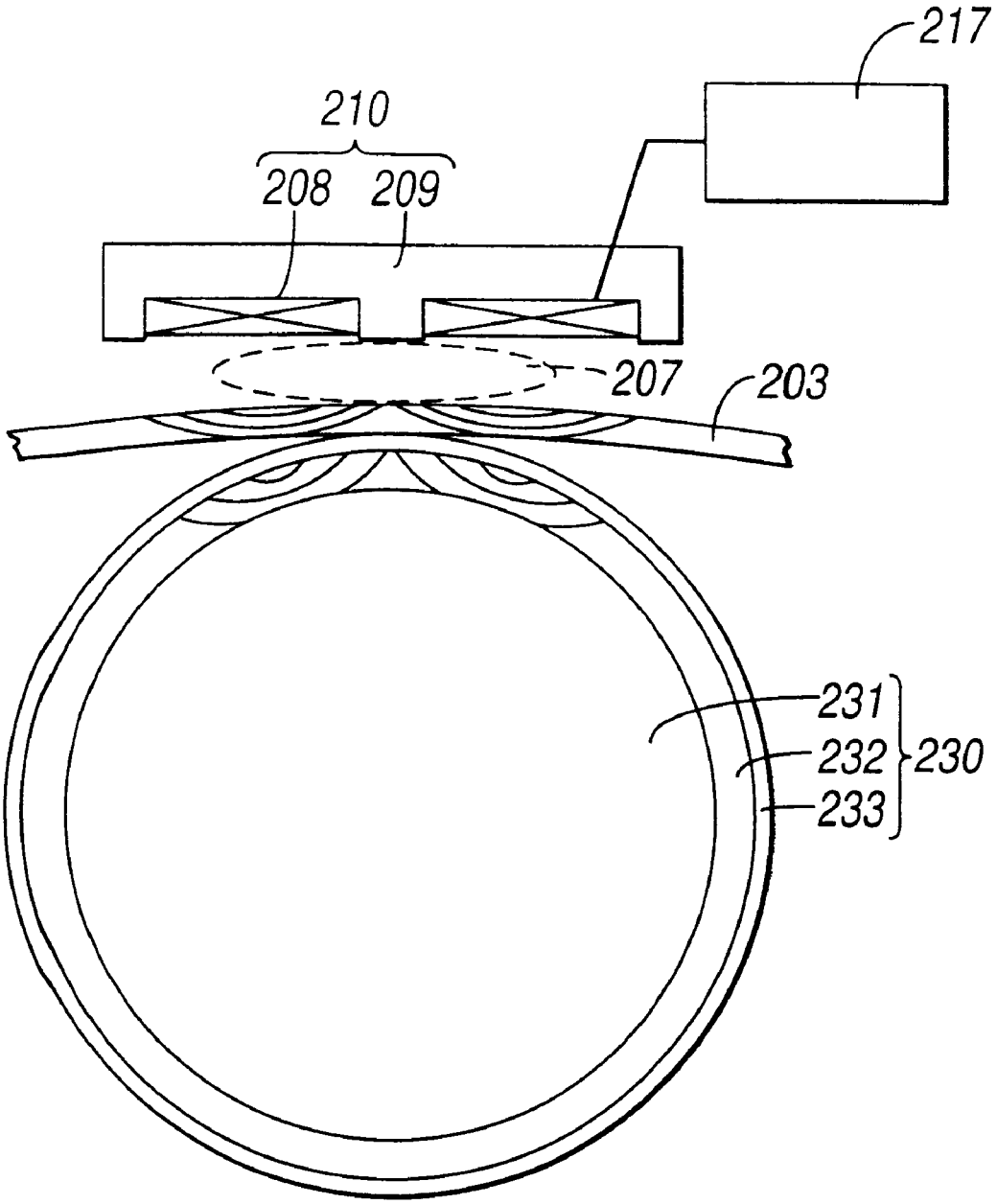
FIG. 20 is a partial sectional view for explaining the construction of the fixing portion of the fixing device shown in FIG. 19.

Further, in the fifteenth embodiment, the heat generated on the surface of the fixing belt 203 is prevented from being taken by the contact with the pressure roller by induction heating the surface of the pressure roller jointly with the fixing belt 203. The fifteenth embodiment will be described referring to FIGS. 19 and 20. In the fifteenth embodiment, as the constructions other than a pressure roller 230 are the same as those already explained in the ninth embodiment, the explanation thereof will be omitted.

In the fifteenth embodiment, the pressure roller 230 is composed of a ceramics made base roller 231 in 20 mm diameter having the large heat insulating effect, a 50 $\mu$m thick conductive nickel layer 232 formed on the surface of the base roller 231 and a fluorine film 233 formed on the outer surface of the conductive layer 232. Here, the conductive layer 232 can be made of such magnetic materials as iron, nickel, stainless steel, etc. but must be the same material as the fixing belt 203. Further, the material of the base roller 231 is not limited to ceramics but any heat insulating material is usable.

When high-frequency current is applied to the coil 208 of the magnetic field generating means 210 from the power source 217 when performing the fixing operation using the fixing device shown in the fifteenth embodiment, magnetic flux and eddy current are generated on portions opposite to the fixing belt 203 comprising a conductive material and the magnetic field generating means 210 of the conductive layer 232 of the pressure roller 230. Magnetic flux is concentrated especially to a position near the nipping portion by the action of the ferrite core 209 of the magnetic field generating means 210. When eddy current is generated on the surface of the fixing belt 203, Joule heat is generated by resistance of the fixing belt 203 itself and the surface temperature of the fixing belt 203 is raised. In addition, eddy current is also generated on the conductive layer 232 of the pressure roller 230 and the surface of the pressure roller 230 is also heated.

Thus, it becomes possible to heat the paper P supplied for the fixing from its back and a rising time needed to reach a fixing temperature can be made short. Furthermore, a temperature difference between the front and the back of the paper P is reduced as a result of the heating from the back of the paper and generation of toner offset can be prevented. In addition, while the fixing belt 203 is contacting the pressure roller 230 between the preceding and succeeding paper, escape of heat from the fixing belt is less because of a small temperature difference between them and the stable fixing performance can be always provided. Reference numeral 205 shown in FIGS. 14–19 is an oil roller. The oil roller 205 is arranged so as to contact the outer surface of the fixing belt 203. The oil roller 205 applies oil on the surface of the fixing belt 203 to prevent a toner from offsetting on the surface of the fixing belt 203. That is, the oil roller 205 supplies oil that is held in its inside to the surface of the fixing belt 203 by rotating following the fixing belt 203.

As described above, according to the ninth through the fifteenth embodiments of the present invention, as heat insulating effect is given by providing an air layer between the magnetic field generating means and the fixing belt, heat generated on the fixing belt is not transferred to the magnetic field generating means and it becomes possible to improve thermal efficiency.

Further, as a distance between the fixing belt and the magnetic field generating means is kept at a constant level, the air layer produced between them can be made always at a constant thickness and a constant heating insulating effect can be obtained.

Furthermore, as a heat exchange member was provided in the cross direction of the fixing belt, it is able to prevent generation of uneven temperatures in the cross direction of the fixing belt and provide a stable fixing performance.

In addition, as the pressure roller itself which is in contact with the fixing belt is also heated by the induction heating, it is prevented that the amount of heat generated on the fixing belt is taken by the heating roller and therefore, it is possible to always provide a constant fixing capacity without lowering the temperature of the fixing belt even between a preceding and succeeding passing paper.

What is claimed is:

1. A fixing device comprising:

a conductive and magnetic hollow roller;

a metallic layer made of high thermal conductive material formed on the outer surface of the hollow roller;

magnetic field generating unit provided in the hollow roller for generating eddy current on the hollow roller;

a power source for applying high-frequency current to the magnetic field generating means; and a pressure roller that is kept in contact with the hollow roller in a specified nipping width.

2. A fixing device claimed in claim 1, wherein the metallic layer includes a copper plating.

3. A fixing device claimed in claim 1, further comprising:

a separation layer formed on the metallic layer.

4. A fixing device claimed in claim 1, wherein the magnetic field generating unit includes:

a ferrite core; and a litz wire made of copper wire and wound round the ferrite core.

5. A fixing device claimed in claim 1, wherein the magnetic field generating unit is arranged at a position opposite to a nipping portion formed by the hollow roller and the pressure roller.

6. A fixing device comprising:

a conductive magnetic hollow roller;

a heating unit provided in the hollow roller for heating the surface of the hollow roller by generating magnetic flux and eddy current on the surface of the hollow roller;

diffusion means provided on the outer surface of the hollow roller for transmitting the heat generated on the surface of the hollow roller by the heating unit while diffusing the heat; and a pressure roller that is kept in contact with the hollow roller in a specified nipping width.

7. A fixing device claimed in claim 6, wherein the diffusion means includes a metallic layer made of high thermal conductor and formed on the outer surface of the hollow roller.

8. A fixing device claimed in claim 7, wherein the metallic layer includes a copper plating.

9. A fixing device claimed in claim 6, further comprising:

a separation layer formed on the diffusion means.

10. A fixing device claimed in claim 6, wherein the heating unit includes:

a ferrite core; and a litz wire made of copper wire and wound round the ferrite core.

11. A fixing device comprising:

a first hollow roller made of a first metal;

a second roller fitted to the outer surface of the first roller and made of a second metal that is differing from the first metal;

a coil provided in the first hollow roller and arranged by extending in the axial direction of the first and the second rollers;

current applying means for selectively switching and applying a first frequency current and a second frequency current differing from the first frequency to the coil; and a third roller contacting the second roller in a specified nipping width.

12. A fixing device claimed in claim 11, wherein the first roller has a length in the axial direction that is in accord with a specified paper size and the second roller has a length in the axial direction that is slightly longer than a maximum paper size that can be fixed.

13. A fixing device claimed in claim 12, wherein the current applying means applies a first frequency current to the coil when a fixing paper size is a first paper size and applies a second frequency current to the coil when a fixing paper size is a second paper size.

14. A fixing device claimed in claim 11, wherein the both ends of the coil are provided by projecting from the ends of the first and the second rollers in the axial direction.

15. A fixing device claimed in claim 11, wherein the first frequency current applied from the current applying means generates eddy current on the first roller only and the second frequency current applied from the current applying means generates eddy current on the second roller only.

16. A fixing device comprising:

a first hollow roller having a first length and made of a first metal;

a second roller having a second length longer than the first length and fitted to the outer surface of the first roller and made of a second metal that is differing from the first metal;

a magnetic field generating means for generating eddy current selectively on the surface of the first and the second roller; and a third roller that is in contact with the second roller in a specified nipping width.

17. A fixing device comprising:

a first hollow roller having a first length and made of a first metal;

a second roller having a second length longer than the first length and fitted to the outer surface of the first roller and made of a second metal that is differing from the first metal;

a magnetic field generating means for generating eddy current on the of the first roller or the second roller according to a fixing paper size; and a third roller that is in contact with the second roller in a specified nipping width.

18. A fixing device comprising:

a first hollow roller having a first length and made of a first metal;

a second roller having a second length longer than the first length and fitted to the outer surface of the first roller and made of a second metal that is differing from the first metal;

a magnetic field generating means for generating eddy current selectively on the surface of the first and the second roller; and a third roller that is in contact with the second roller in a specified nipping width.

* * * * *